United States Patent [19]

Saltz

[11] 4,135,832

[45] Jan. 23, 1979

[54] BINDER AND APPARATUS FOR RETAINING LEAVES THEREIN

[75] Inventor: Ira M. Saltz, Greenlawn, N.Y.

[73] Assignee: Lubliner/Saltz, Inc., New York, N.Y.

[21] Appl. No.: 850,554

[22] Filed: Nov. 11, 1977

[51] Int. Cl.[2] ..... B42F 13/06; B42F 13/08

[52] U.S. Cl. ..... 402/15; 402/8

[58] Field of Search ..... 402/8, 14, 15, 16, 17, 402/68, 77

[56] References Cited

U.S. PATENT DOCUMENTS 3,362,412 1/1968 Moller ..... 402/15

FOREIGN PATENT DOCUMENTS 2308905 9/1974 Fed. Rep. of Germany ..... 402/8

*Primary Examiner*—Travis S. McGehee

*Attorney, Agent, or Firm*—Darby & Darby

[57] ABSTRACT

A binder for removably retaining perforated leaves is disclosed. A relatively flat binder or folder is provided with at least one holder for retaining perforated leaves. The holder includes an actuating member having a first end mounted to one of the covers of the binder for pivotal movement about a cover axis which is parallel to the spine of the binder and spaced therefrom. The second end of the actuating member is mounted to the other cover of the binder for sliding movement along its inner surface. The holder also includes a flexing member which extends through one set of perforations in the leaves in order to retain them in the binder. The flexing member has a first end which is secure to the binder at a point between the cover axis and the second end of the actuating member. The second end of the flexing member is secured near the second end of the actuating member. This construction permits the second end of the actuating member to slide along the surface of the cover to which it is slidably mounted when the binder is opened and closed. This sliding movement is toward the spine of the binder when it is opened and away from the spine of the binder when it is closed. As a result, the flexing member is bowed to extend above the binder when the binder is opened and is substantially flattened out when the binder is closed.

26 Claims, 11 Drawing Figures

BINDER AND APPARATUS FOR RETAINING LEAVES THEREIN

This invention relates generally to binders for perforated leaves and, more particularly, concerns apparatus for removably retaining the perforated leaves within the binder.

Binders which releasably retain perforated leaves are well known in the prior art. A typical binder includes a mechanism having a number of openable rings inside the binder on its spine. The leaves or pages are retained in the binder by passing the rings through perforations at one edge of each leaf and closing the rings. Leaves may be removed or replaced by opening the rings.

Although such binders are very convenient because they permit the leaves to lie flat and to be moved freely, they suffer from a number of shortcomings which are undesirable in such devices. For example, the diameter of the rings determines the minimum thickness of the binder and, even if a small number of leaves are to be contained in the binder, it must be thick enough to accommodate the rings. This wastes space unnecessarily in an office where many different binders are maintained. Also, if thin binders are used, there is the problem of having too many binders for one matter or consolidating them periodically. In addition, it takes a substantial force to open and close the rings of the binder so that the user, in closing the rings, may accidentally clamp the flesh of his fingers or hands between the segments of the ring and be injured thereby. This presents a safety hazard when the binder is to be used by children (e.g. for school). Furthermore, the mechanism incorporating such ring tends to be relatively heavy, includes a relatively complex and expensive mechanical system, and must usually be made of metal. These factors make such a binder unnecessarily expensive.

Prior art attempts have been made to solve the aforementioned disadvantages, particularly the storage problem. For example U.S. Pat. Nos. 1,227,685; 2,773,504; and 3,246,653 disclose leaf retaining apparatus which allow a binder to be thinner when closed, because the leaf retainers expand when the binder is opened and contract when it is closed. However, these devices are still relatively expensive, are still rather complex mechanically and do not permit convenient removal or replacement of leaves.

Broadly, it is an object of this invention to provide a binder for perforated leaves which overcomes one or more of the disadvantages in prior art binders of this type. Specifically, it is within the contemplation of this invention to provide a binder which permits free turning of the enclosed leaves when open, yet is not appreciably thicker than the stack of contained leaves when closed.

It is another object of this invention to provide a device for retaining perforated leaves in a binder which permits ready and convenient removal and replacement of the leaves.

It is a further object of this invention to provide a binder of the type described and a mechanism for retaining leaves therein which are convenient, reliable and safe in use, yet relatively simple and inexpensive in construction.

In accordance with the invention, a relatively flat binder or folder is provided with at least one holder for retaining perforated leaves. The holder includes an actuating member which has a first end mounted to one of the covers of the binder for pivotal movement about a cover axis which is parallel to the spine of the binder and spaced therefrom. The second end of the actuating member is mounted to the other cover of the binder for sliding movement along its inner surface. The holder also includes a flexing member which extends through one set of perforations in the leaves in order to retain them in the binder. The flexing member has a first end which is secure to the binder at a point between the cover axis and the second end of the actuating member. The second end of the flexing member is secured near the second end of the actuating member. This construction permits the second end of the actuating member to slide along the surface of the cover to which it is slidably mounted when the binder is opened and closed. This sliding movement is toward the spine of the binder when it is opened and away from the spine of the binder when it is closed. Consequently, the flexing member is bowed to extend above the binder when the binder is opened and is substantially flattened out when the binder is closed. This permits the binder to be substantially flat when closed yet provides a ring-like bowed flexible member when the binder is opened, so that the leaves are easily turned.

In accordance with illustrative embodiments illustrating objects and features of the present invention, three different versions of the leaf retaining apparatus are disclosed. Each of these is conveniently made from resilient sheet material, for example plastic, and includes a flexing member which is detachably secured at one of its ends so that the leaves are conveniently removed or replaced.

The foregoing brief description, as well as other objects, features and advantages of the present invention will be more completely understood from the following detailed description of presently preferred, but nonetheless illustrative, embodiments of the present invention, with reference being had to the accompanying drawing, in which.

Figure 1:
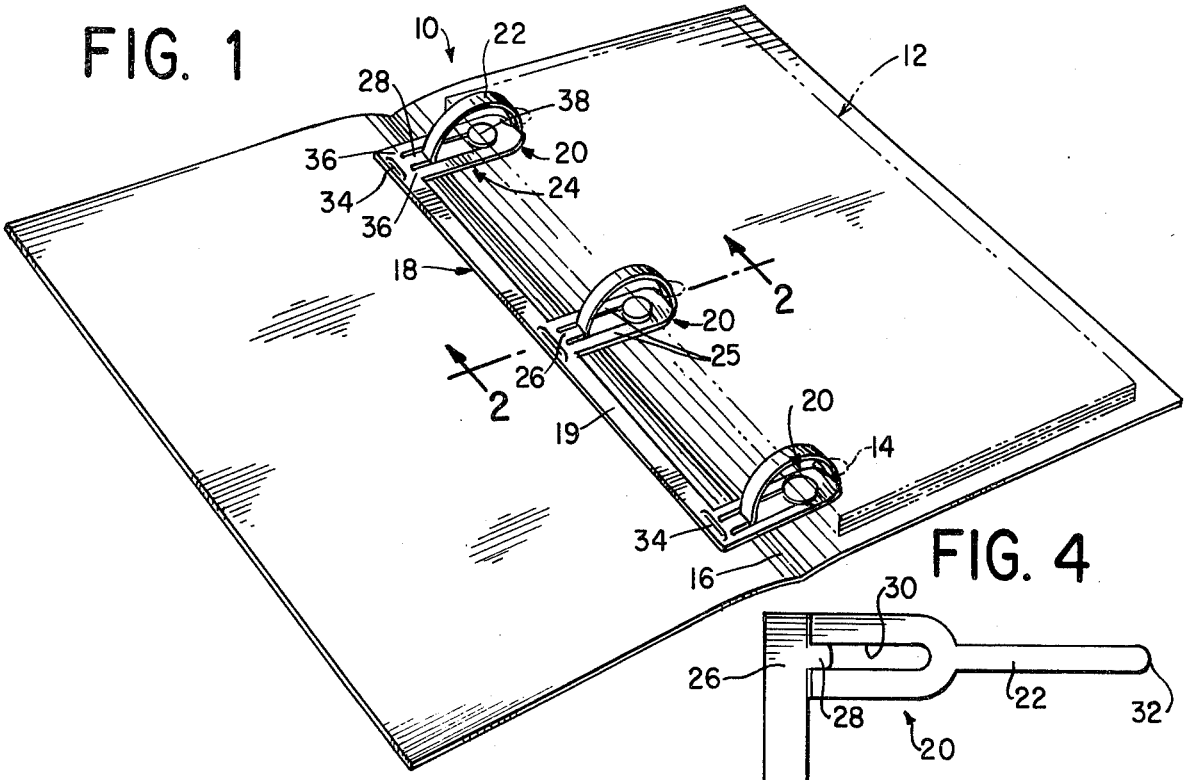
FIG. 1 is a perspective view of a first embodiment of the invention in which a conventional folder is provided with a leaf retaining apparatus including three leaf holders.
Figure 2:
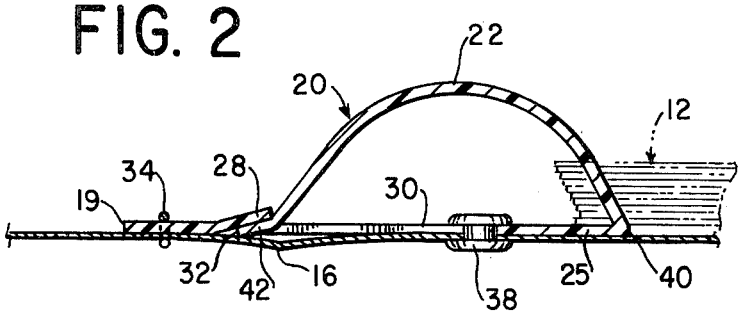
FIG. 2 is a fragmentary sectional view, on an enlarged scale, taken along line 2—2 in FIG. 1 to show the details of one of the leaf holders with the binder in the open position.
Figure 3:
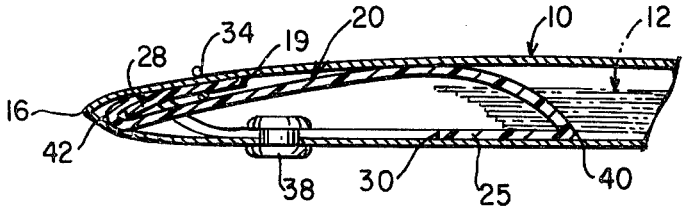
FIG. 3 is a sectional view similar to FIG. 2 with the binder in the closed position.

Referring now to the details of the drawing, and in particular to FIGS. 1–3, there is shown a binder 10 for removably retaining leaves 12 which have perforations 14. The binder 10 is creased to form a spine 16 and is conveniently opened and closed by being folded along the spine. A leaf retaining apparatus 18 is provided inside the binder and includes a plurality of leaf holders 20 in side by side alignment along the spine 16. The leaf holders retain leaves 12 by means of flexing members 22 which extend through the leaf apertures 14.

Figure 4:
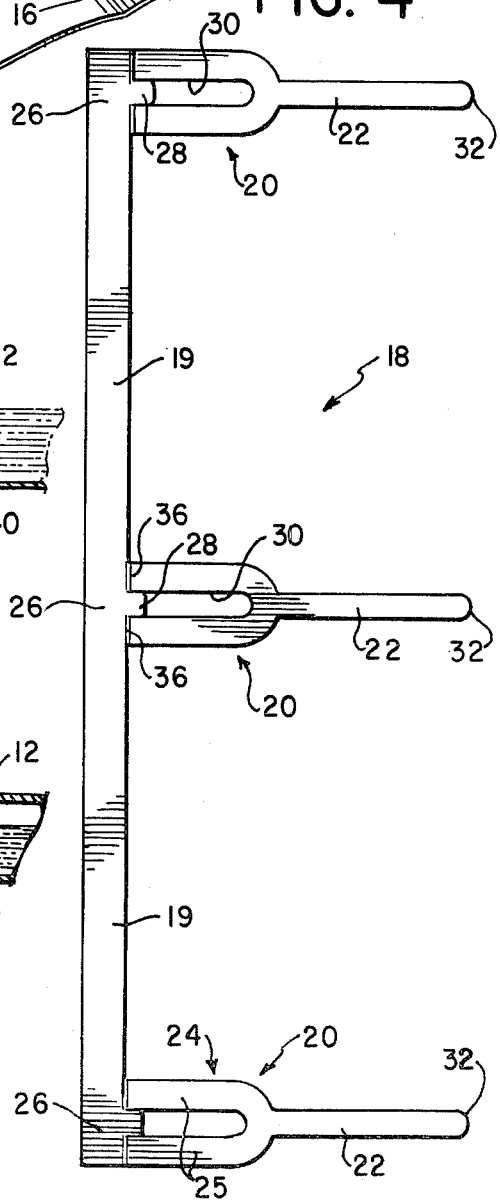
FIG. 4 is a plan view of the blank used to form the leaf retaining apparatus incorporated in the binder of FIG. 1.

The leaf retaining apparatus 18 may be made of any resilient sheet material, but is preferably made of plastic in the form of the blank shown in FIG. 4. The individual leaf holders 20 are retained in side by side arrangement by means of the connecting strips 19 which are formed between them. Each leaf holder 20 broadly comprises a flexing member 22 and an actuating member 24. Each actuating member 24 is bifurcated and, at a first end thereof, the furcations 25, 25 are joined by a bridging portion 26 which is an extension of the connecting strips 19. A small tab 28 extends from each bridging portion 26 into the channel 30 formed between the furcations 25, 25. One end of the flexing member 22 (hereafter called the second end) is joined to the second end of the actuating member 24, and the first end 32 of each flexing member 22 is free.

The leaf retaining apparatus 18 is mounted to one of the covers (the left-hand cover is selected in the drawing by way of example) of the binder 10 with the connecting strips 19 parallel to the spine 16 and the tips of the tabs 28 extending substantially to the spine. Although in FIG. 1 retaining apparatus 18 is secured by means of staples 34, it will be appreciated that any conventional securing or bonding means may be used. Preferably, the actuating members 24 are creased and/or scored at 36 so that they will more readily pivot with respect to their bridging portions. Each of the actuating member 24 is slidably mounted with respect to the right-hand cover of binder 10 by means of a rivet 38, or the like. The rivet is selected so that its shaft portion is narrower than the channel 30 in each actuating member 24 while its upper head is wider than that channel. This permits free sliding movement of each actuating member with respect to its rivet and the right-hand cover of the binder, while maintaining the actuating member in contact with the cover. To complete assembly of the binder the flexing members 22 are inserted through corresponding perforations 14 in the leaves 12 and the first or free end 32 of each flexing member is wedged between the lefthand cover and the corresponding one of the tabs 28. Preferably, the flexing members 22 are creased at 40 to permit free flexing thereof and at 42 to assure that the free end thereof will not be pulled out from under tab 28 during use.

With the described construction and arrangement of elements, the actuating members 24 pivot freely about the creases 36 as the covers of the binder 10 are opened and closed. However, the opposite end of each of the actuating members, which is mounted for sliding movement with respect to the right-hand binder cover, slides away from spine 16 as the binder is closed and towards spine 16 when the binder is opened (compare the distance of crease 40 from spine 16 in FIGS. 2 and 3). As a result of being fixed to the second end of an actuating member 24, the second end of each of the flexing members 22 also moves away from spine 16 when the binder is closed and towards spine 16 when the binder is opened. Inasmuch as the first end of each of the flexing members 22 is fixed with respect to spine 16 by virtue of the securing tab 28, each flexing member is bowed upwardly as its crease 40 moves toward spine 16 (binder open as in FIG. 2) and is flattened as crease 40 moves away from spine 16 (binder closed as in FIG. 3). Inasmuch as the flexing members 22 bow upwardly when the binder 10 is opened, the leaves 12 may be freely moved and lie in a flat position. However, when the binder is closed, the flexing members 22 flatten out and permit the closed binder to be substantially flat.

Figure 5:
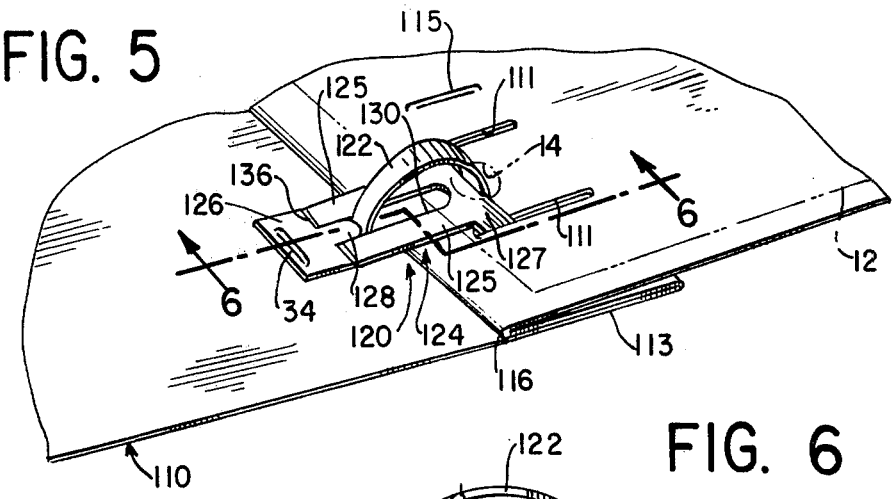
FIG. 5 is a fragmentary perspective drawing showing a second embodiment of the invention in which individual leaf holders having a construction different from that of the leaf holders of FIG. 1 are provided in a binder.
Figure 6:
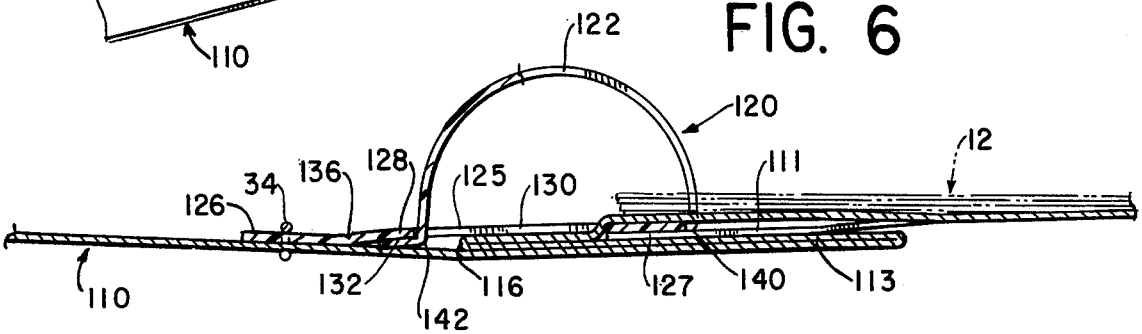
FIG. 6 is a fragmentary sectional view, on an enlarged scale, taken along contour 6—6 in FIG. 5 with the binder in the open position.
Figure 7:
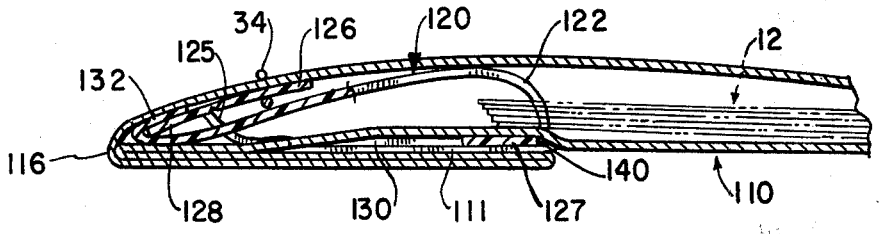
FIG. 7 is a sectional view similar to FIG. 6 with the binder in the closed position.

Referring to FIGS. 5–7, there is shown, as a second embodiment, a binder 110 incorporating objects and features of the present invention. The binder 110 includes a plurality of leaf holders 120 which are similar to the leaf holders 20 of FIG. 1. The primary difference between the leaf holders 120 and the leaf holders 20 is that each of the former includes a pair of lateral, oppositely directed tabs 127, 127 at the second end of the actuating member 124. These tabs are designed to fit into parallel slots 111, 111 in the right-hand cover of binder 110 so as to permit actuating member 124 to slide with respect to the cover. Although the leaf holders 120 are individually mounted in the binder 110, it will be appreciated that a leaf retaining apparatus, such as 18 in FIG. 1, could be utilized by forming the leaf holders 120 from a single sheet of material with connecting strips therebetween. One additional distinction of the binder 110 is that a fold 113 is formed near the spine 116 so that the slits 111 are not visible from the exterior of the binder. The fold 113 is held flat against the right-hand cover by means of staples 115 or any other conventional joining or bonding means.

Figure 8:
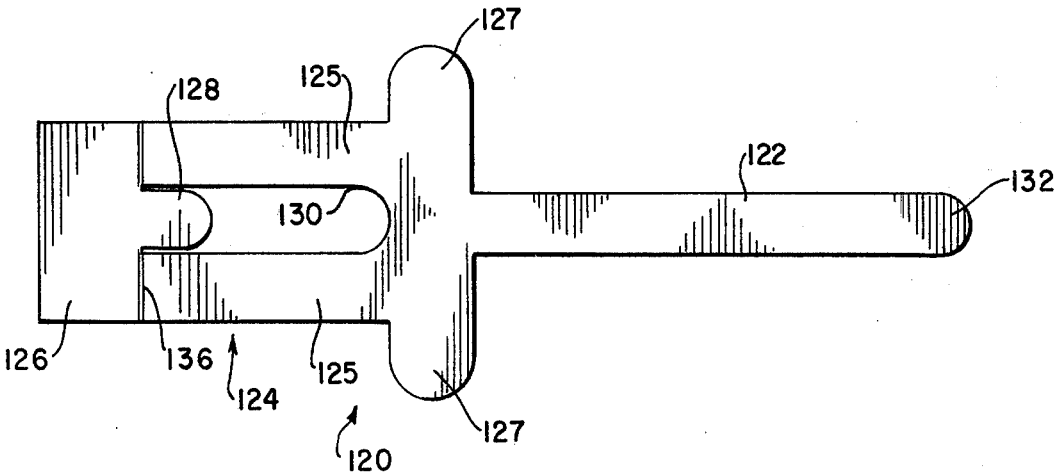
FIG. 8 is a plan view, on an enlarged scale, of the blank used to form each of the leaf holders in FIG. 5.

The leaf holders 120 may be made of any resilient sheet material, but are preferably made of plastic cut in the form of the blank shown in FIG. 8. As will be appreciated from FIGS. 5–8, except for distinctions already mentioned, leaf holders 120 are substantially identical to leaf holders 20 in both construction and operation. In order to reflect this identity, corresponding elements of binders 10 and 110 are designated by common reference numerals, but the elements of binder 110 are all designated with an initial "1". Further details of the construction, use and operation of binder 110 will, therefore, be understood by referring back to the description relating to binder 10 while keeping in mind the related nomenclature.

Figure 9:
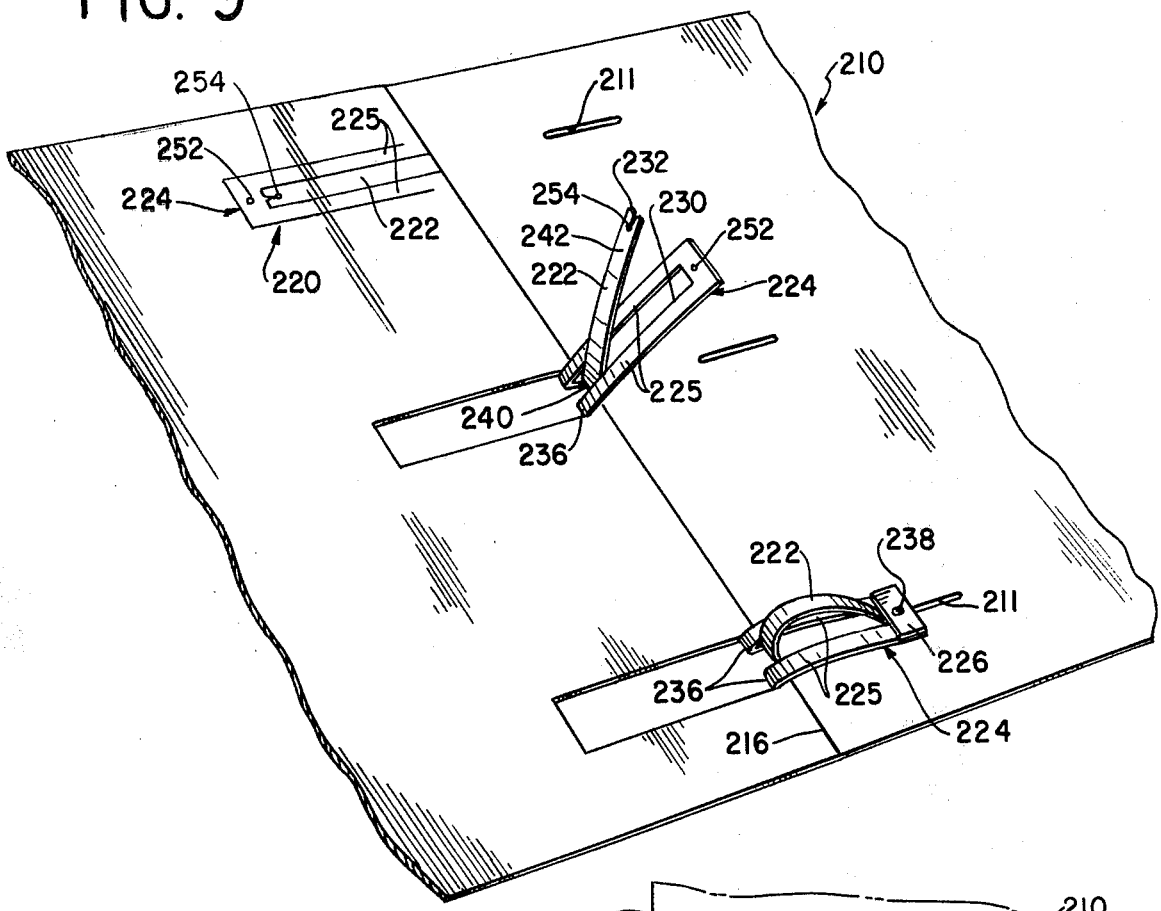
FIG. 9 is a fragmentary perspective view of a third embodiment of the invention in which the binder and leaf holders are formed from a single sheet of material, the three leaf holders being shown in successive stages of assembly.
Figure 10:
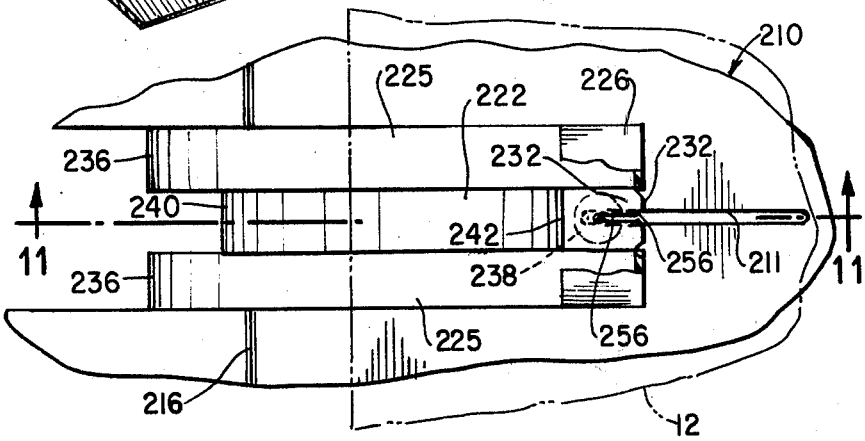
FIG. 10 is a fragmentary plan view, on an enlarged scale, showing a fully assembled leaf holder with parts broken away to show further construction details.
Figure 11:
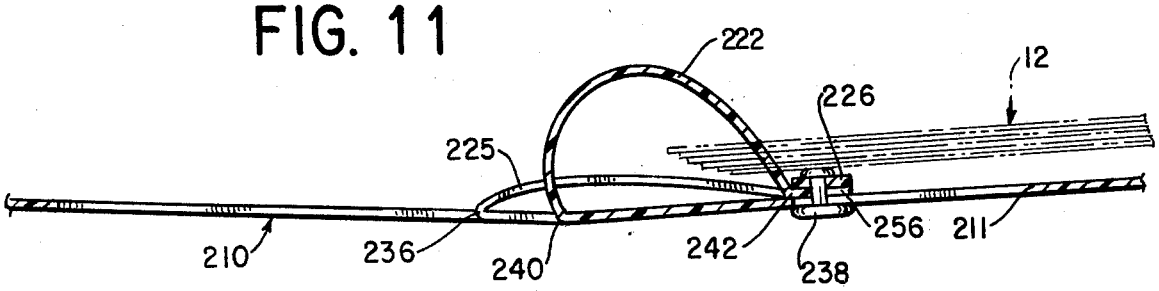
FIG. 11 is a fragmentary sectional view, on a reduced scale, taken along line 11—11 in FIG. 10.

FIGS. 9–11 illustrate, as a third embodiment, a binder 210 incorporating objects and features of the present invention. In this embodiment, three leaf holders 220 and the covers of the binder 210 are all formed from a single sheet of material. As can be seen in FIG. 9, the flexing members 222 and actuating members 224 are cut from the right-hand cover of binder 210, are creased, and then coupled to the left-hand cover of the binder by means of rivets 238. Each rivet is slidable within a slot 211 and also serves to removably retain the free end 232 of flexing member 222, which retains the perforated leaves 12.

The binder 210 may be made of any flexible sheet material, but is preferably made of plastic. The actuating members 224 are formed by cutting tabs in the left-hand cover of the binder which terminate at a distance from the binder spine 216. Each flexing member 222 is formed by cutting a tab inside an actuating member 224 so as to extend all the way to the spine 216. Holes 252 and 254, which are dimensioned to accept the shaft portion of rivet 238, are formed in members 224 and 222, respectively, at equal distances from the end 232. In addition, a slit 256 is formed between end 232 and hole 254 to bifurcate that end. The width of slot 256 is less than the diameter of the shaft portion of rivet 238.

After the members 222 and 224 are cut from the sheet comprising binder 210, they are creased and/or scored at 236 and 240, respectively to form pivotal joints. It should be noted that the crease 240 is made along spine 216, whereas the creases 236 are at a distance from the spine. In addition, end 232 is bent backward (toward the left in FIG. 9) and/or scored to form the crease 242. In this partial state of assembly, the leaf holder 220 has the appearance of the center leaf holder in FIG. 9. It should be noted that actuating member 224 is bifurcated and has a bridging portion 226 joining the furcations 225, 225. To complete assembly of actuating member 224, bridging portion 226 is folded backwards over the actuating member and a rivet 238 is inserted through the slot 211 and hole 252 to secure the actuating member to the right-hand cover. The rivet 238 is formed so as to permit actuating member 224 to slide freely with respect to right-hand cover.

Perforated leaves are added to the binder by slipping the flexing members 222 into corresponding perforations 14 of the leaves and securing end 232 of each flexing member between bridging portion 226 of the corresponding actuating member 224 and the right-hand cover of binder 210. Securement of the flexing member 222 is achieved by placing end 232 between the furcations 225 of the corresponding actuating member and applying pressure to slide this end under bridging portion 226 and away from spine 216. Slot 256 at end 232 has a flared mouth which engages the shaft portion of rivet 238 when end 232 is first inserted under bridging portion 226. As pressure is applied to urge end 232 towards rivet 238, the furcations at end 232 separate and the shaft portion of the rivet enters slot 256. As further pressure is applied, the shaft portion of rivit 238 advances into slot 256 until it enters hole 254. At this point, the furcations at end 232 snap back together and end 232 is secured to rivet 238. Flexing member 222 can be detached from rivet 238 by applying a force to pull end 232 away from bridging portion 226 of actuating member 224. It is then possible to add or replace perforated leaves.

It will be appreciated that when binder 210 is fully assembled (See FIG. 11), it closely resembles binders 10 and 110 and operates in substantially the same manner. To symbolize this relationship, corresponding elements of binders 10 and 210 have been designated with similar reference characters, except that all elements of binder 210 have an intial "2". Keeping this related nomenclature in mind, further details of operation and use of binder 210 will be understood by referring back to the corresponding description for binders 10 and 110.

Although specific embodiments of the invention have been disclosed for illustrative purposes, it will be appreciated by those skilled in the art that many additions, modifications and substitutions are possible without departing from the scope and spirit of the invention as defined by the accompanying claims.

What is claimed is:

1. In a binder for leaves having perforations adjacent an edge thereof, said binder including a pair of covers hingedly joined at a spine thereof to permit closing the binder by bringing its covers together and opening the binder by separating its covers, at least one leaf holder for retaining said leaves in said binder, comprising:

an actuating member having a first end mounted to one of said covers for pivotal movement about a cover axis parallel to said spine and spaced therefrom, the second end of said actuating member being mounted to the other of said covers for sliding movement thereon so that said second end slides towards and away from said spine when said binder is opened and closed, respectively; and a flexing member extending through a corresponding perforation on each leaf, said flexing member having a first end secured to be in contact with said binder at a fixed point intermediate said cover axis and the position of the actuating member second end when said binder is fully opened, the second end of said flexing member being secured near the actuating member second end so as to slide therewith, whereby said flexing member is bowed away from said covers when said binder is opened and is flattened towards said covers when said binder is closed.

2. A binder in accordance with claim 1 wherein said flexing member first end engages said binder at said spine.

3. A binder in accordance with claim 1 further comprising means for detachably securing at least one of said flexing member first and second ends.

4. A binder in accordance with claim 1 wherein at least one end of said flexing member is constructed and arranged to pivot with respect to the element to which it is secured.

5. A binder in accordance with claim 1 wherein said actuating and flexing members are formed from a single sheet of resilient material;

said actuating member being bifurcated and having a bridging portion between said furcations at, at least, one end thereof;

said flexing member being dimensioned to extend between the actuating member furcations and beyond said actuating member to engage said binder.

6. A binder in accordance with claim 5 wherein the bridging portion at the first end of said actuating member includes a tab extending between said furcations in confronting relationship with said one cover, the first end of said flexing member being constructed and arranged to be inserted and retained between said tab and said one cover.

7. A binder in accordance with claim 5 further comprising means at the second end of said actuating member for releasably retaining the second end of said flexing member.

8. A binder in accordance with claim 7 wherein said other cover includes a slot generally normal to said spine, said releasable retaining means including a shaft secured near said actuating member second end so as to extend through said slot for sliding movement, said shaft extending beyond said other cover and having a head wider than said slot and positioned to prevent said shaft from being withdrawn from said slot, said flexing member having a slot extending thereinto from its second end, said flexing member slot being narrower at its outermost end than the thickness of said shaft and being at least equal to the thickness of said shaft at its innermost end, so that said flexing member is removably connected with said shaft by the resiliency of the flexing member second end when it is mounted to said shaft with said shaft within the widest portion of the slot in said flexing member.

9. A binder in accordance with claim 5 further comprising shaft means mounted to said other cover to protrude above the surface thereof so as to extend between and beyond said actuating member furcations, said shaft means having a head wider than the distance between said furcations and positioned to retain said actuating member in sliding contact with said other cover.

10. A binder according to claim 5 wherein said other cover includes at least one pair of slots generally normal to said spine and separated by a distance at least as great as the width of said actuating member, said actuating member further including a pair of oppositely directed, lateral protrusions near its second end, each protrusion extending into one of said slots for sliding movement therein.

11. A binder in accordance with claim 10 wherein the bridging portion at the first end of said actuating member includes a tab extending between said furcations in confronting relationship with said one cover, the first end of said flexing member being constructed and arranged to be inserted and retained between said tab and said one cover.

12. A binder in accordance with claim 1 wherein said covers and said actuating and flexing members are formed from a single sheet of resilient material;

said actuating member being formed by cutting an elongated tab in said first cover, the sides of said tab terminating at a point spaced from said spine to define the first end of said actuating member;

said flexing member being formed by cutting an elongated tab within the area of said actuating member and extending therealong, the sides of this tab terminating at said fixed point to define the first end of said flexing member.

13. A binder in accordance with claim 11 further comprising means at the second end of said actuating member for releasably retaining the second end of said flexing member.

14. A binder in accordance with claim 13 wherein said other cover includes a slot generally normal to said spine, said releasable retaining means including a shaft secured near said actuating member second end so as to extend through said slot for sliding movement, said shaft extending beyond said other cover and having a head wider than said slot and positioned to prevent said shaft from being withdrawn from said slot, said flexing member having a slot extending thereinto from its second end, said flexing member slot being narrower at its outermost end than the thickness of said shaft and being at least equal to the thickness of said shaft at its innermost end, so that said flexing member is removably connected with said shaft by the resiliency of the flexing member second end when it is mounted to said shaft with said shaft within the widest portion of the slot in said flexing member.

15. A leaf holder for use in a binder for leaves having perforations adjacent an edge thereof, said binder including a pair of covers hingedly joined at a spine thereof to permit closing the binder by bringing its covers together and opening the binder by separating its covers, said leaf holder being used for retaining said leaves in said binder and comprising:

an actuating member having a first end adapted to be mounted to one of said covers for pivotal movement about a cover axis parallel to said spine and spaced therefrom, the second end of said actuating member being adapted to be mounted to the other of said covers for sliding movement thereon so that, when said ends are mounted to said covers, said second end slides towards and away from said spine when said binder is opened and closed, respectively; and a flexing member adapted to be extended through a corresponding perforation on each leaf, said flexing member having a first end adapted to be secured in contact with said binder at a fixed point intermediate said cover axis and the position of the actuating member second end when said binder is fully opened, the second end of said flexing member being adapted to be secured near the actuating member second end so as to slide therewith, whereby, when said leaf holder is mounted in said binder, said flexing member is bowed away from said covers when said binder is opened and is flattened towards said covers when said binder is closed.

16. A leaf holder in accordance with claim 15 wherein said flexing member first end is adapted to engage said binder at said spine.

17. A leaf holder in accordance with claim 15 further comprising means for detachably securing at least one of said flexing member first and second ends.

18. A leaf holder in accordance with claim 15 wherein at least one end of said flexing member is constructed and arranged to pivot with respect to the element to which it is secured.

19. A leaf holder in accordance with claim 15 wherein said actuating and flexing members are formed from a single sheet of resilient material;

said actuating member being bifurcated and having a bridging portion between said furcations at, at least, one end thereof;

said flexing member being dimensioned to extend between the actuating member furcations and beyond said actuating member for engagement with said binder.

20. A leaf holder in accordance with claim 19 wherein the bridging portion at the first end of said actuating member includes a tab extending between said furcations and adapted to be placed in confronting relationship with said one cover, the first end of said flexing member being constructed and arranged to be inserted and retained between said tab and said one cover.

21. A leaf holder in accordance with claim 19 further comprising means at the second end of said actuating member for releasably retaining the second end of said flexing member.

22. A leaf holder in accordance with claim 21 for use in a binder wherein said other cover includes a slot generally normal to said spine, said releasable retaining means including a shaft secured near said actuating member second end so as to be extendable through said slot for sliding movement therein, said shaft extending beyond said other cover, when extended through said slot, and being provided with a head wider than said slot and positioned to prevent said shaft from being withdrawn from said slot, said flexing member having a slot extending thereinto from its second end, which slot is narrower at its outermost end than the thickness of said shaft at and is at least equal to the thickness of said shaft at its innermost end, said flexing member being removably connected with said shaft by the resiliency of the flexing member second end when it is mounted to said shaft with said shaft within the widest portion of the slot in said flexing member.

23. A leaf holder in accordance with claim 19 further comprising shaft means adapted to be mounted to said other cover to protrude above the surface thereof so as to extend between and beyond said actuating member furcations, said shaft means having a head wider than the distance between said furcations and positioned to retain said actuating member in sliding contact with said other cover when it is mounted thereto.

24. A leaf holder according to claim 19 for use with a binder wherein said other cover includes at least one pair of slots generally normal to said spine and separated by a distance at least as great as the width of said actuating member, said actuating member further including a pair of oppositely directed, lateral protrusions near its second end, each protrusion being adapted to extend into one of said slots for sliding movement therein.

25. A leaf retaining assembly for use in a binder for perforated leaves, comprising, in combination:

a plurality of leaf holders in accordance with claim 15 and connection means joining said leaf holders in side-by-side, spaced relationship.

26. A leaf retaining assembly for use in a binder for perforated leaves, comprising, in combination:

a plurality of leaf holders in accordance with claim 19, all formed from a common sheet of material; and connection strips formed from the same sheet as said leaf holders and joining said leaf holders in side-by-side, spaced relationship.

* * * * *